US009650816B2

(12) United States Patent
Okuma

(10) Patent No.: US 9,650,816 B2
(45) Date of Patent: May 16, 2017

(54) VEHICLE SLIDING DOOR LOCKING SYSTEM AND LATCH ASSEMBLY

(71) Applicant: AISIN TECHNICAL CENTER OF AMERICA, INC., Northville, MI (US)

(72) Inventor: Emiko Okuma, Novi, MI (US)

(73) Assignee: AISIN TECHNICAL CENTER OF AMERICA, INC., Northville, MI (US)

( * ) Notice: Subject to any disclaimer, the term of this patent is extended or adjusted under 35 U.S.C. 154(b) by 267 days.

(21) Appl. No.: 14/333,032

(22) Filed: Jul. 16, 2014

(65) Prior Publication Data

US 2016/0017644 A1 Jan. 21, 2016

(51) Int. Cl.

| | |
|---|---|
| ***E05C 3/06*** | (2006.01) |
| ***E05B 83/40*** | (2014.01) |
| ***E05B 81/20*** | (2014.01) |
| *E05B 79/20* | (2014.01) |
| *E05B 81/06* | (2014.01) |
| *E05B 81/24* | (2014.01) |

(52) U.S. Cl.

CPC ..... *E05B 83/40* (2013.01); *E05B 81/20* (2013.01); *E05B 79/20* (2013.01); *E05B 81/06* (2013.01); *E05B 81/25* (2013.01)

(58) Field of Classification Search

CPC ..... E05B 77/30; E05B 77/22
USPC ..... 292/201, DIG. 23, 216
See application file for complete search history.

(56) References Cited

U.S. PATENT DOCUMENTS

| | | | | |
|---|---|---|---|---|
| 5,520,425 | A | 5/1996 | Dowling | |
| 5,718,465 | A * | 2/1998 | Dowling | E05B 65/0841 292/216 |
| 5,921,612 | A * | 7/1999 | Mizuki | B60J 5/12 292/341.16 |
| 6,343,817 | B1 * | 2/2002 | Watanabe | E05B 77/30 292/201 |
| 2014/0001771 | A1 | 1/2014 | Shibayama et al. | |

FOREIGN PATENT DOCUMENTS

| | | |
|---|---|---|
| JP | 2008-115615 | 5/2008 |
| JP | 2009-264004 | 11/2009 |

* cited by examiner

*Primary Examiner* — Mark Williams
(74) *Attorney, Agent, or Firm* — Oblon, McClelland, Maier & Neustadt, L.L.P.

(57) ABSTRACT

A locking system including a latch assembly that actuates a cancel cable and thereby a cancel lever of a lock device includes a latch lever that has a first engaging surface and receives a striker positioned at the end of a rail of a vehicle, a cancel latch lever including an engagement tab that is engaged by the first engaging surface of the latch lever in an overstroke position of the latch lever, and a cancel cable that interrupts a transmission of power from an actuator to a lock device in accordance with a rotation of the latch cancel lever occurring from an engagement of the engagement tab with the engagement surface.

8 Claims, 10 Drawing Sheets

VEHICLE SLIDING DOOR LOCKING SYSTEM AND LATCH ASSEMBLY

BACKGROUND OF THE DISCLOSURE

Land vehicles such as vans may be provided with side doors that slide along a length of the vehicle. These doors may be include power locking systems which automatically close and lock the side doors having been slid into a position to be locked in a closed or open position. These doors have advantages of allowing passengers to enter and exit a vehicle without having to exert energy or be concerned properly closing and locking a sliding door.

FIELD OF THE DISCLOSURE

Exemplary aspects of the present disclosure relate to a latch assembly for a power slide door including a latch cancel lever for interrupting a transmission of power from a motor in a lock device that has malfunctioned and does not permit proper closure of a sliding door.

DESCRIPTION OF THE RELATED ART

Vehicle door locking systems related to the locking system of the present disclosure may be of the type incorporated in a power sliding 10 door and configured to include a remote control device 100 to operate a rear locking device 110, a front locking device 120, and a lower rail open door lock device 130 with a series of cables as illustrated in FIG. 2. In particular, when an inside or outside handle is operated, first and second open cables (140, 150) connecting the remote control device 100 to the rear locking device 110 and the front locking device 120 respectively, may be operated by the remote control device 100 to open the sliding door 10 from a closed and locked state. Upon opening, the sliding door 10 may be locked in a full open position by the lower rail open door lock device 130. As with the first open cable 140, and the second open cable 150, a third open cable 180 connecting the lower rail open door lock device 130 to the remote control device 100, may be actuated to open the lower rail open door lock device 130 so the sliding door 10 may be closed.

Upon closing the sliding door, the rear locking device 110 will lock the sliding door 10 in the closed position using an actuator such as a motor. In the locking system illustrated in FIG. 2, when an actuator of the rear locking device 110 malfunctions it is necessary to interrupt a power transmitting connection between the actuator and a locking mechanism of the rear locking device 110, in order to close the sliding door 10 by a manual operation. The remote control 100 is connected to the rear locking device 110 by a cancel cable 170 that interrupts the transmission of motion from the actuator to the locking mechanism when actuated. However, the cancel cable 170 of the related locking system must be operated by an inside or outside handle.

SUMMARY OF THE DISCLOSURE

The present application relates to a power slide door for an exterior door of a vehicle including a locking system with a latch assembly provided in a roller hinge arm, and connected to a cancel lever of a lock device by a cancel cable. This allows a user to interrupt a transmission of power from a motor that has malfunctioned to a locking device with a simple movement of the sliding door past a full open position.

Here, the latch assembly of the locking system actuates a cancel cable and thereby a cancel lever of a lock device includes a latch lever that has a first engaging surface and receives a striker positioned at the end of a rail of a vehicle, a cancel latch lever including an engagement tab that is engaged by the first engaging surface of the latch lever in an overstroke position of the latch lever, and a cancel cable that interrupts a transmission of power from an actuator to a lock device in accordance with a rotation of the latch cancel lever occurring from an engagement of the engagement tab with the engagement surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
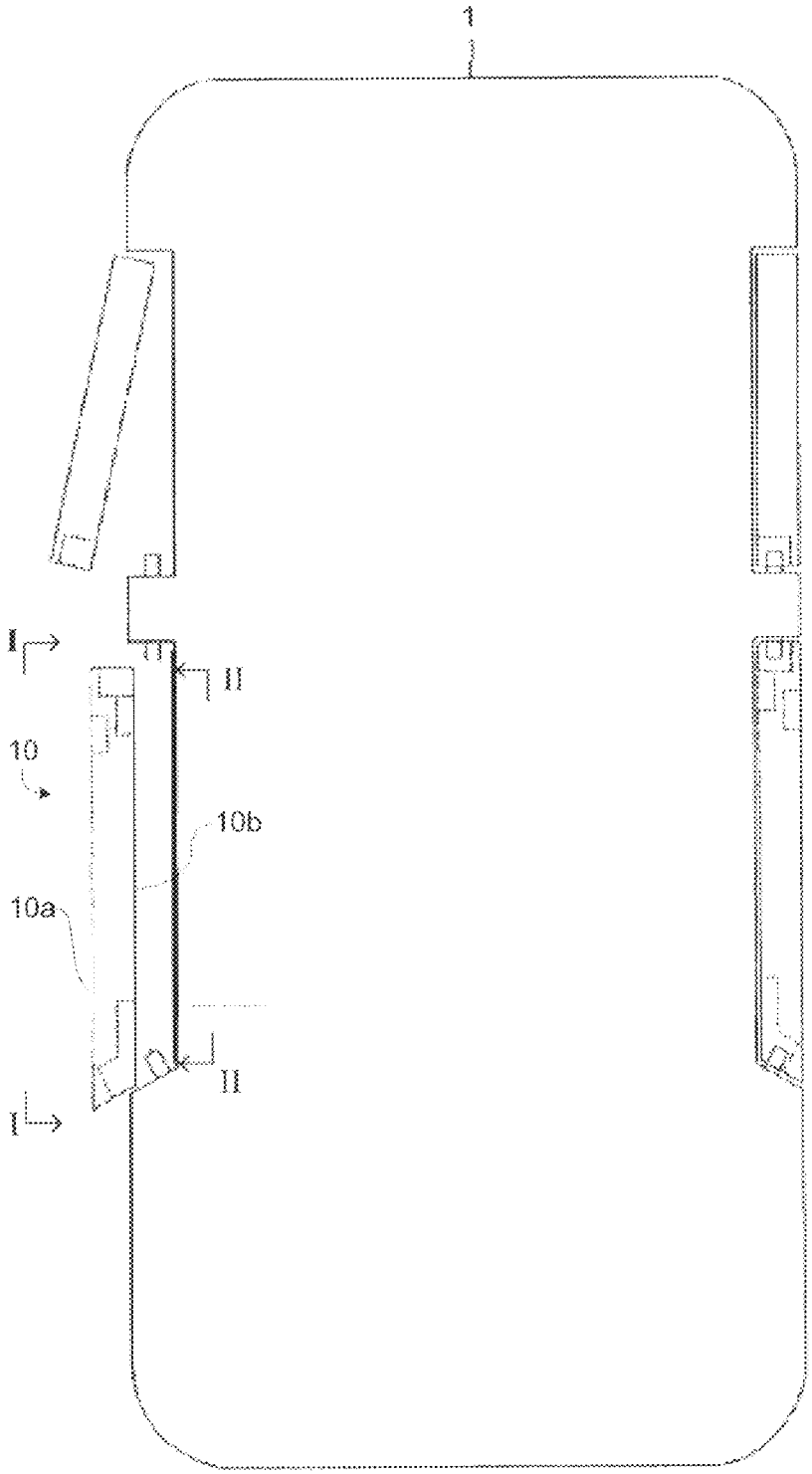
FIG. 1 illustrates a top view of a vehicle including a sliding door in accordance with the present disclosure.

Referring now to the drawings, wherein like reference numerals designate identical or corresponding parts throughout the several views. Further, as used herein, the words "a," "an" and the like generally carry a meaning of "one or more," unless stated otherwise.

FIGS. 1 and 3-10B depict various aspects of a locking system of a vehicle door in accordance with the present disclosure. Here a vehicle refers to a land vehicle exemplified by a passenger van or minivan. However, the present disclosure is also applicable to any similar type vehicle, such as but not limited to, a sport utility vehicle, a commercial vehicle, or the like.

FIG. 1 illustrates an exemplary embodiment of a vehicle 1 including a power sliding door 10. An outside handle (not shown) is accessible from an outer side 10*a* of the sliding door 10, and an inside handle (not shown) is accessible from an inner side 10*b* of the sliding door 10.

Figure 3:
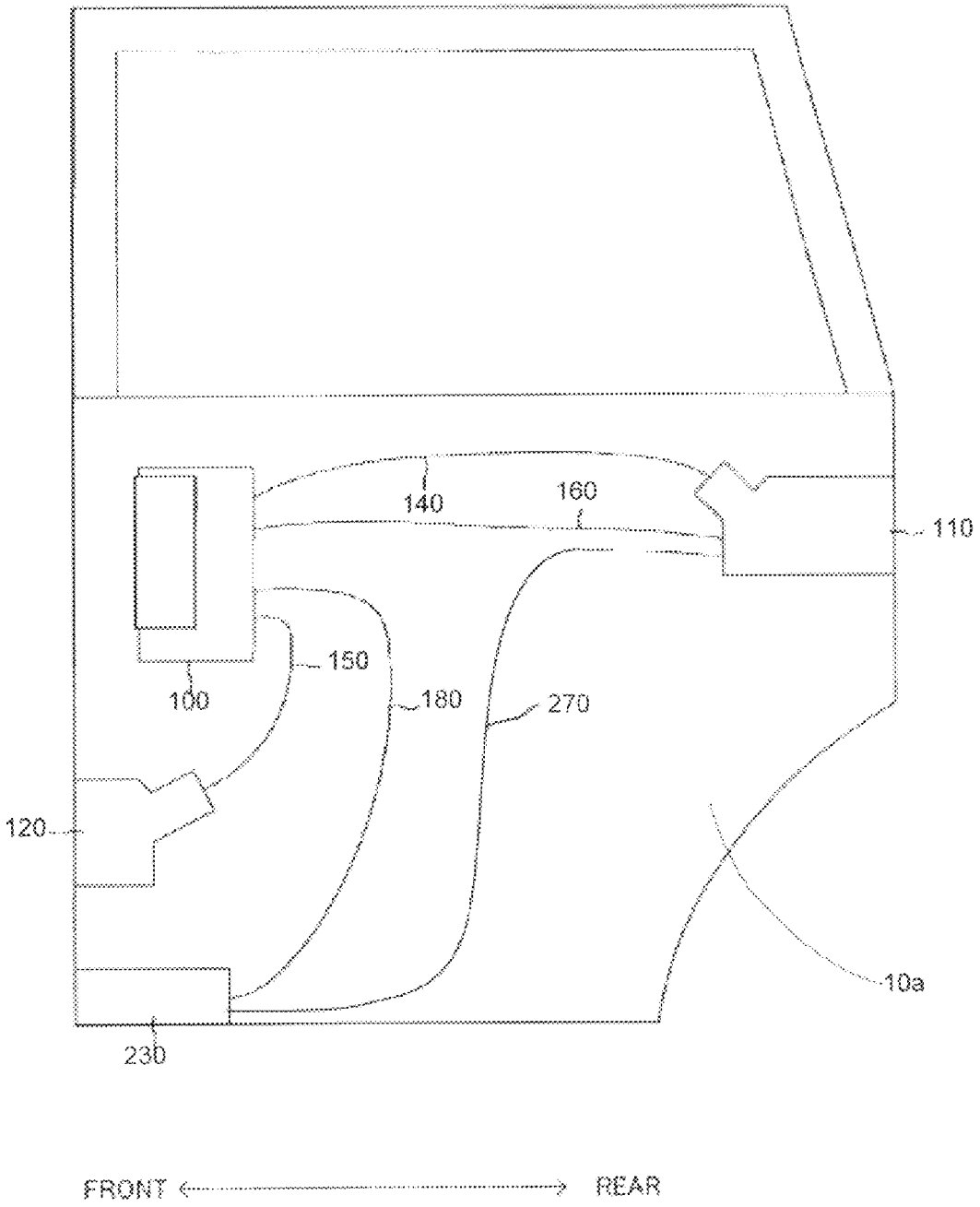
FIG. 3 schematically illustrates a side view of a sliding door including a locking system in accordance with the present disclosure.

FIG. 3 schematically illustrates a non-limiting exemplary embodiment of a locking system incorporated in the sliding door 10 as viewed from line I-I of FIG. 1. The locking system of the present disclosure includes the remote control device 100, rear locking device 110, and the front lock device 120 of the related locking system, and an open door lock/canceling latch assembly 230 in accordance with the present disclosure.

Figure 4:
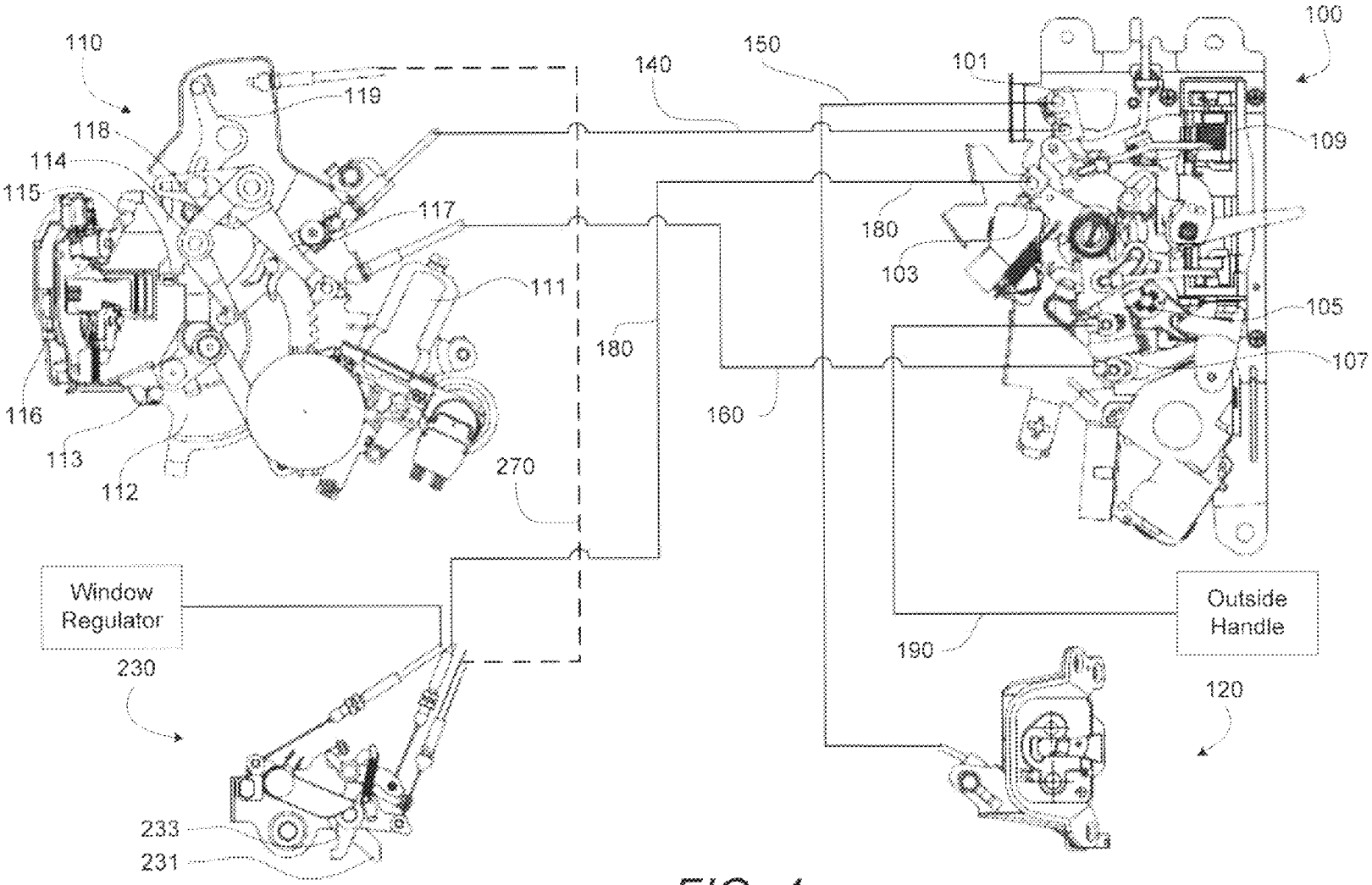
FIG. 4 schematically illustrates an arrangement of a locking system in accordance with the present disclosure.

FIG. 4 schematically illustrates an arrangement of the locking system according to the instant disclosure. The remote control device 100 includes a control device open lever 101 connected to a rear lock device open lever 114 by the first open cable 140, and connected to the front lock device 120 with the second open cable 150. When the control device open lever 101 is rotated in the clockwise direction, both the front lock device 120 and the rear lock device 110 are opened. This corresponds to an open operation of the sliding door 10. The remote control device 100 is connected to the open door lock/canceling latch assembly 230 by third open cable 180. An outside handle lever 105 is connected to an outside handle by cable 190. A control device release lever 107 is connected to a first lock device release lever 117 by a release cable 160.

The remote control device 100 may be in a locked condition and an unlock condition as selected by a user. In a locked condition, the control device open lever 101 is restricted from rotating. As a result, an operation of the inside or outside handle does not result in a rotational motion being transmitted to the control device open lever 101, the first and second open cables (140, 150) are not retracted, and the rear lock device 110 and the front lock device 120 are not opened. In contrast, when the remote control device 100 is in the unlocked condition the control device open lever 101 may rotate as a result of the operation of an inside or outside handle.

An open door lock lever 103 of the remote control device 100 is connected to the open lock/canceling device 230 with the third open cable 180. The outside handle lever of the remote control device 100 is connected to the outside handle via outside handle cable 190. The control device 100 includes a control device release lever 107 that is connected to a lock device release lever 117 of the lock device 110.

The rear lock device 110 includes an active lever 112, a seesaw lever 113, a lock device open lever 114, a pawl driving lever 115, the lock device release lever 117, a relay lever 118, and the lock device cancel lever 119. The rear lock device 110 also includes a motor 111. Actuation of the motor 111 in a clockwise or counterclockwise direction will rotate the active lever 112 in a corresponding direction. The active lever 112 transmits its motion to one of the relay lever 118 and the seesaw lever 113 to operate the lock device latch 116. The lock device cancel lever 119 may be actuated in the situation where there is a malfunction of the motor 111 so that the rear lock device 110 can operate under manual power.

Figure 2:
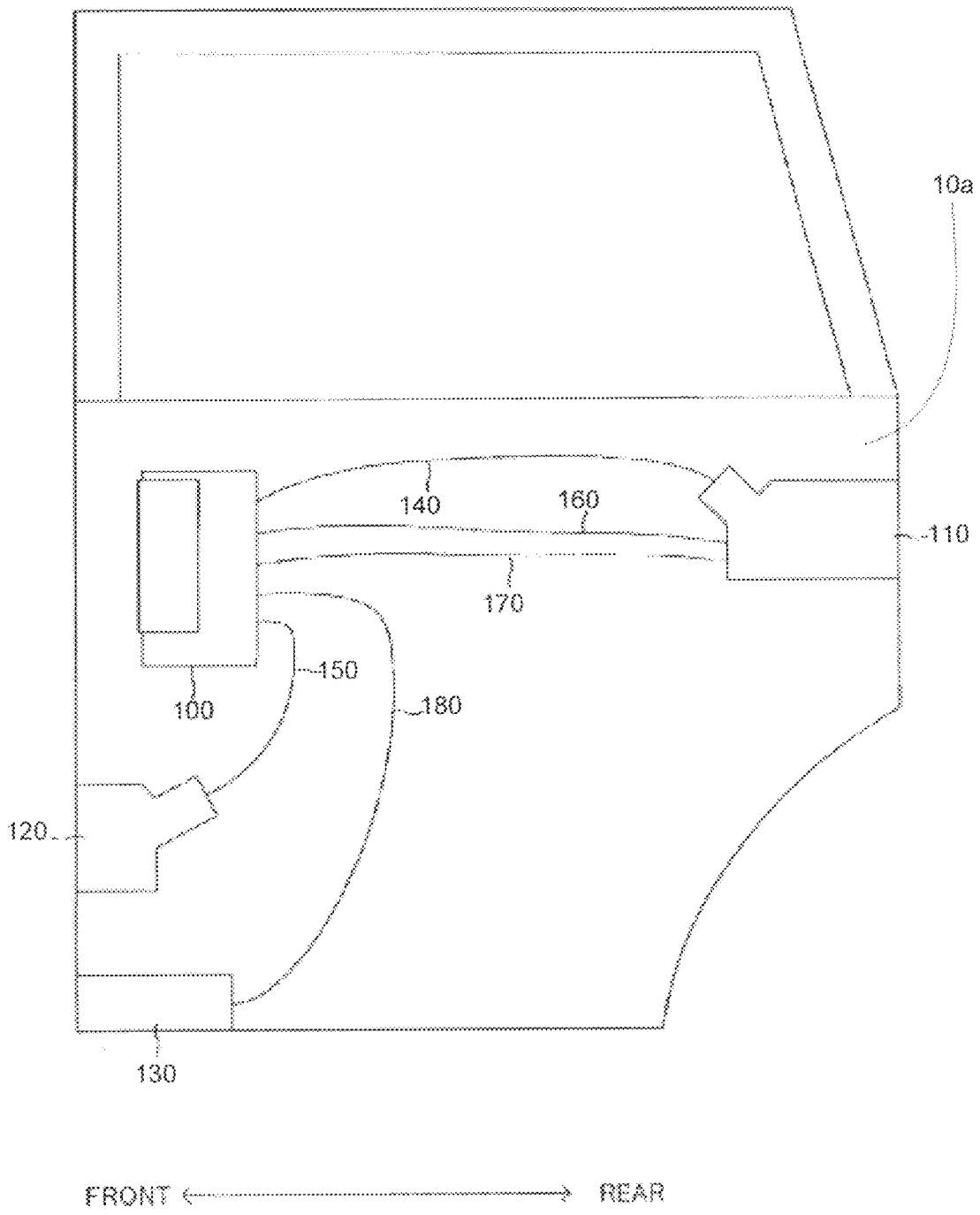
Related Art FIG. 2
FIG. 2 schematically illustrates a side view of a sliding door including a locking system related to a locking system of the present disclosure.

In the locking system of FIG. 2 the lock device cancel lever 119 would be operated by the actuation of the cancel cable 170 by the remote control device 100. The lock device cancel lever 119 could therefore only be actuated by the operation of the inside handle or the outside handle (not shown). Unlike the related locking system, the lock device cancel lever 119 in the locking system according to the present disclosure is connected to the open door lock/canceling latch assembly 230 by a latch cancel cable 270. The open door lock/canceling device 230 includes a latch lever 231 which is used to lock the sliding door 10 in an open position, and to actuate the movement of a latch cancel lever 233 with a movement of the sliding door 10. If there is a malfunction with the motor 111, rendering the lock device open lever 114 and the seesaw lever 113 inoperative because the active lever 112 cannot be moved, the latch cancel lever 233 of the open door lock/canceling device 230, can be operated to disengage and interrupt the transmission of power between the motor 111 and the lock device release lever 116 via the actuation of the lock device cancel lever 119.

Figure 5:
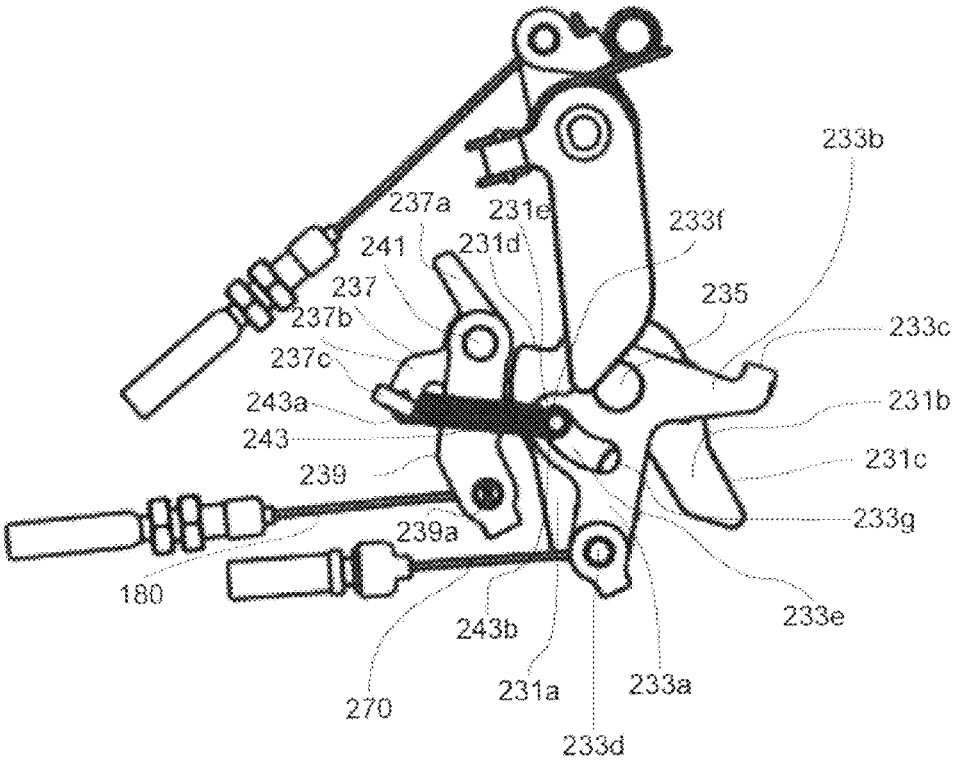
FIG. 5 illustrates a top view of a latch assembly in accordance with the present disclosure.

FIG. 5 illustrates a top view of the open door lock/canceling device 230 according to an embodiment of the present disclosure. The latch lever 231 includes a first portion 231*a* and a second portion 231*b* that extend from a main body of the latch lever 231, which rotates about a first axis of rotation pin 235. A first engagement surface 231*c* is provided on a leading edge of the second portion 231*b*, and a second engagement surface 231*d* forms a trailing edge of first portion 231*a* according to a direction of rotation of the latch lever 231 moving towards a locked position. A latch lever pin 231*e* extends from a surface of the latch lever 231 facing a bottom surface of the latch cancel lever 233.

The latch cancel lever 233 includes a cable attachment portion 233*a* and an engagement portion 233*b* extending from a respective main body which also rotates about the first axis of rotation pin 235. An engagement tab 233*c* is provided on a leading edge of the engagement portion according to a direction of rotation corresponding to locking direction of the latch lever 231. A mounting portion 233*d* of the latch cancel lever 233 is provided to attach the latch cancel cable 270 to the cable attachment portion 233*a*. In the main body of the latch cancel lever 233, between the attachment portion 233*a* and the engagement portion, defined therein is a latch pinhole 233*e* having a pinhole first end 233*f* and a pinhole second end 233*g*.

The latch lever pin 231*e* of the latch lever 231 extends through the latch pinhole 233*e* of the latch cancel lever 233, and is connected to a ratchet 237 that is positioned below an open lock unlocking lever 239. The ratchet 237 and the open lock unlocking lever 239 rotate about a second axis of rotation 241 according to a movement of the third open cable 180. The second axis of rotation 241 is defined by a pin that is mounted on a base plate (not shown) which includes a stopper tab for limiting a counterclockwise rotation of the ratchet 237 and the open lock unlocking lever 239. The movement of the ratchet 237 in the counterclockwise direction is restricted by a tab 237*a* that comes into abutment with the stopper tab (not shown).

The ratchet 237 is provided with a first extension 237*b* which includes a resilient member mounting portion 237*c*. A first end 243*a* of a resilient member 243 is hooked to the resilient member mounting portion 237*c*, and a second end 243*b* is attached to the latch lever pin 231*e*. By the connection to the resilient member mounting portion 237*c*, a counterclockwise motion of the latch lever 231 is eventually transmitted to the ratchet 237 through the resilient member 243 after the latch lever 231 rotates a certain amount corresponding to a locked position of the latch lever 231. In the locked position of the latch lever 231, the latch lever 231 is prevented from rotating in a clockwise direction by the ratchet 237 coming into abutment with the second engagement surface 231*d* of the latch lever 231.

The latch lever 231 and the latch cancel lever 233 rotate about the first axis of rotation pin 235. Rotation of the latch lever 231 about the first rotation first axis of rotation pin 235 causes the latch lever pin 231*e* to move within the pinhole 233*g*. The latch lever pin 231*e* moves relative to the latch cancel lever 233 within the pin hole 233*e* from the first pin hole end 233*f* to the second pin hole end 233*g*. Thus, the latch lever 231 moves relative to the latch cancel lever 233 until the latch lever 231 rotates to a locked position corresponding to a locked condition of the sliding door 10 in a full open position. Continued rotation of the latch lever 231 in the counterclockwise direction (an overstroke rotation) will result in the first engagement surface 231*c* abutting an engagement tab 233*c* of the latch cancel lever. Further rotation of the latch lever 231 with first engagement surface 231*c* pressed against the engagement tab 233*c* will cause the latch cancel lever 233 to rotate in a counterclockwise direction pulling the latch cancel cable 270. In the alternative, the pin hole 233*e* may be configured so that a motion of the latch lever 231 is transmitted to the second end of the pin hole 233*g* of latch cancel lever 233 by the latch lever pin 231*e*.

Figure 6:
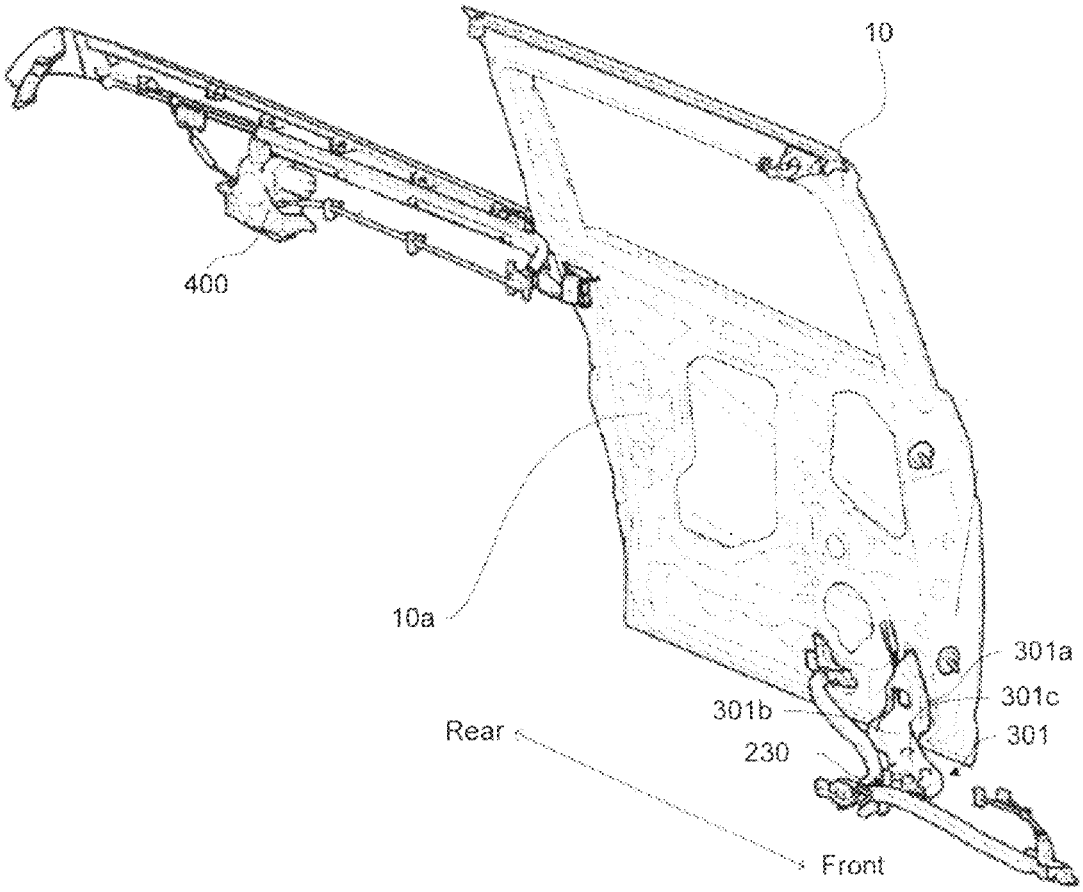
FIG. 6 illustrates an isometric view of a sliding door in accordance with the present disclosure.

FIG. 6 illustrates a non-limiting exemplary embodiment of the vehicle door 10 including a power sliding door actuator 400 and a roller hinge arm 301 in accordance with the present disclosure. The power sliding door actuator 400 may include a motor for actuating the sliding door 10 to move between open and closed positions without the aid of a user. The roller hinge arm 301 as illustrated in FIG. 6 includes a mounting plate 301*a*, an arm portion 301*b*, and a rail engagement end 301*c*. The open lock/canceling latch assembly 230 is installed in the rail engagement end 301*c* and moves along a side of the vehicle 1 with the sliding door 10 between the rail (not show) and the inner side 10*b* of the sliding door 10.

Figure 7A:
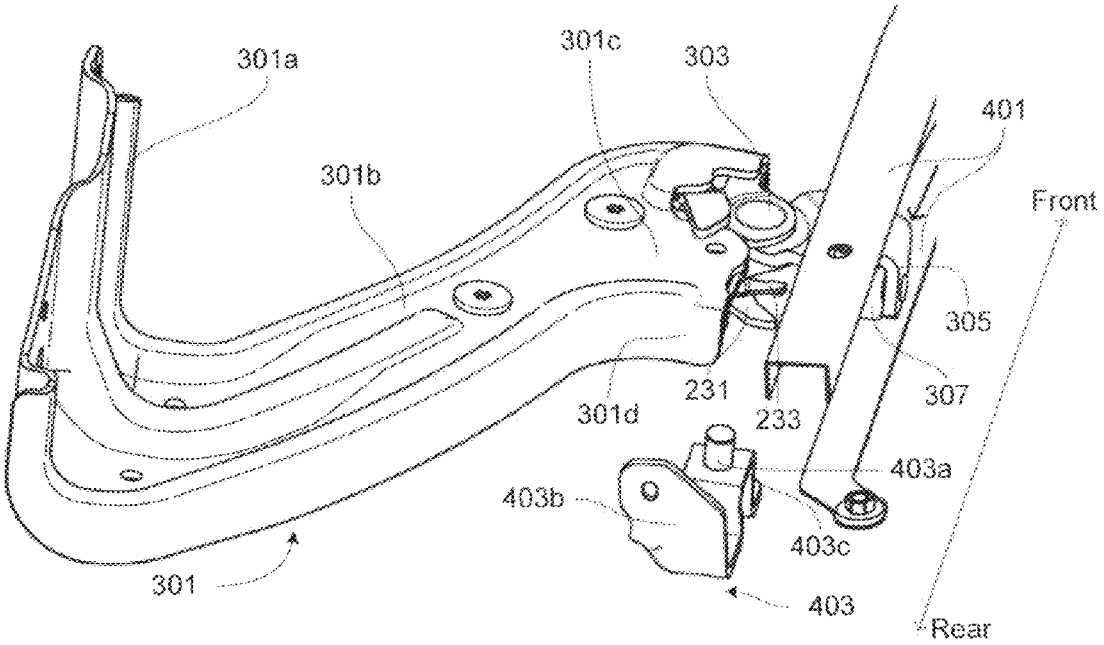
FIG. 7A illustrates an isometric view of an arm assembly and a striker structure in accordance with the present disclosure.
Figure 7B:
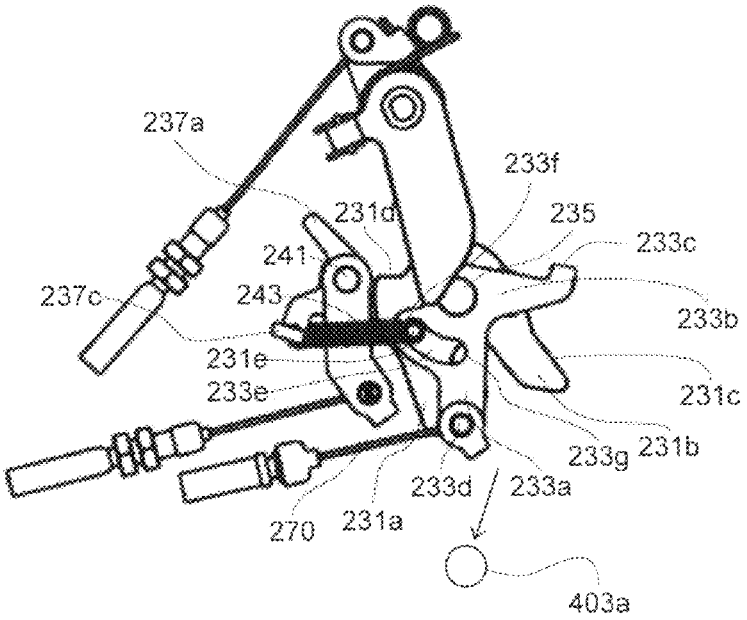
FIG. 7B illustrates a top view of a latch assembly and a striker in accordance with the present disclosure.

An open door locking operation of the locking system according to the present disclosure will now be described with reference to FIGS. 7A-8C. FIG. 7A includes an illustration of a rail 401 not shown in FIG. 6, in which a roller 307 connected to a roller bracket 305 moves. The roller bracket 305 is mounted to the engagement end 301*c* of the roller hinge arm 301. FIGS. 7A and 7B illustrate a situation in which the roller hinge arm 301 is moving towards a full open locking member 403 positioned near a rear end of the rail 401. Prior to engaging with a striker 403*a* of the full open locking member 403, the latch lever 231 is in a rotational position in which the second portion 231*b* extends from an end 301*c* of the roller hinge arm 301 at an angle pointing in a direction towards the striker 403*a*.

As illustrated in FIG. 7B, in this position the open door lock/canceling device 230 is positioned so that a latch lever pin 231*e* is in abutment with the pinhole first end 233*f* of the latch cancel lever 233. As the roller hinge arm 301 moves in a rear direction from a front portion of the vehicle 1 towards the striker 403*a*, the striker 403*a* will engage the open lock/canceling latch device 230 by being received between the first portion 231*a* and the second portion 231*b* of the latch lever 231. As the roller hinge arm 301 is moved further towards the rear, the latch lever 231 will rotate in a counterclockwise direction along with the latch lever pin 213*e* within the pinhole 233*f*. The latch cancel lever 233 will remain in a stationary position while the resilient member 231 is extended.

As the open lock/canceling latch assembly 230 progresses towards the rear of the vehicle 1 having received the striker 403*a*, the open lock/canceling latch assembly 230 will approach the locked position corresponding to the fully open condition of the sliding door 10.

The latch lever 231 will rotate about the first axis of rotation pin 235, with a side of the first portion 231*a* near the second engaging surface 231*d* of the latch lever 231 sliding along a side of a ratchet locking portion 237*d* of the ratchet 237, until the ratchet 237 is no longer prevented from rotating in a counter clockwise direction by the latch lever 231. As illustrated in FIG. 8B, the latch lever 231 rotates into a locked position with the striker 403*a* received, the ratchet 237 is rotated under the bias of the resilient member 243, and the ratchet locking portion 237*d* rotates behind the latch cancel lever 233 to come into abutment with the second engaging surface 231*d*.

Figure 8A:
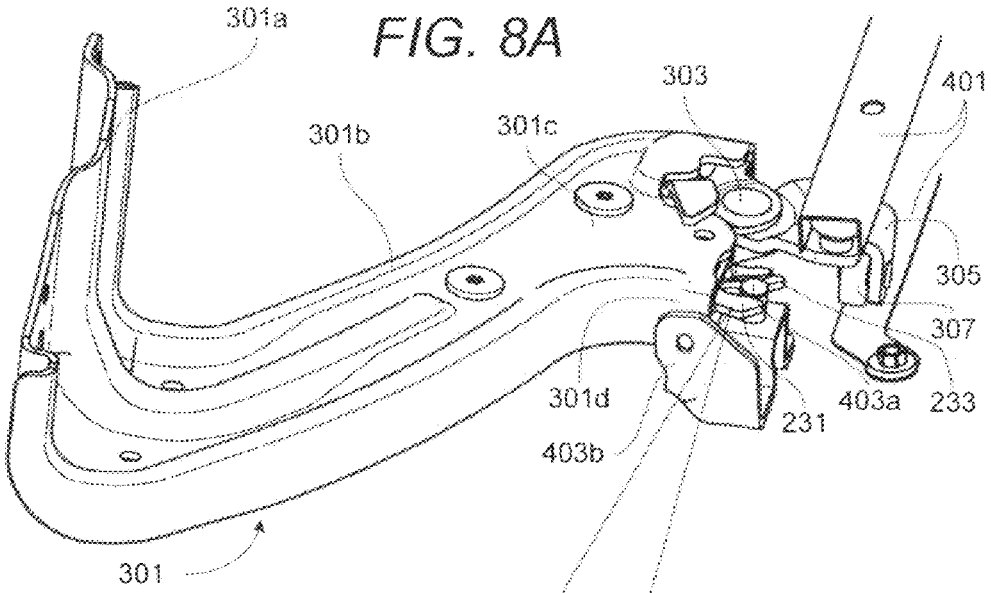
FIG. 8A illustrates an isometric view of an arm assembly in a position corresponding to a locked position of a latch assembly in accordance with the present disclosure.
Figure 8B:
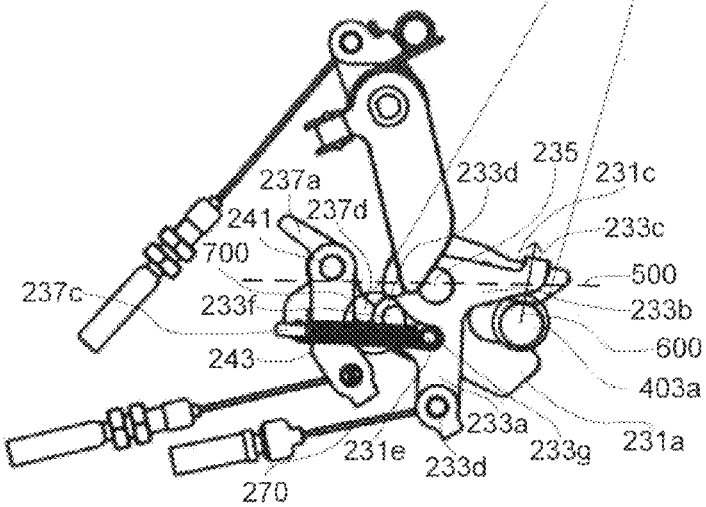
FIG. 8B illustrates a top view of a latch assembly and a striker structure in a locked position in accordance with the present disclosure.
Figure 8C:
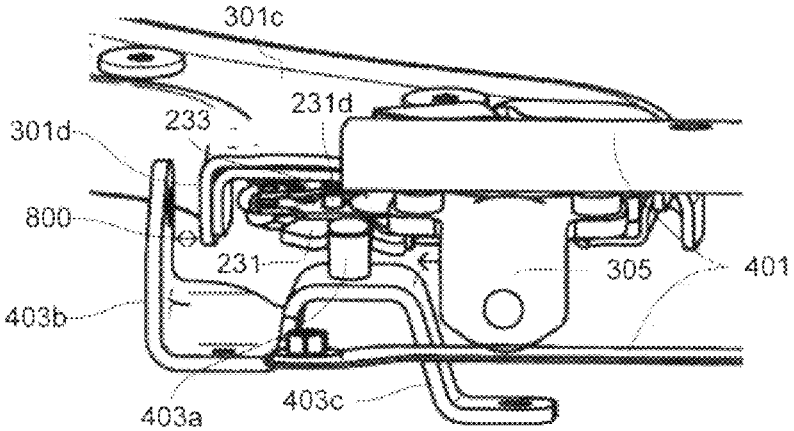
FIG. 8C illustrates a front view of an arm assembly including a latch assembly engaged with a striker structure in a locked position in accordance with the present disclosure.

When the striker 403*a* is fully received and the latch lever pin 231*e* reaches the second pinhole end 233*g* as illustrated in FIGS. 8A-8C, the door 10 will be in an open lock door position. FIG. 8B shows a locking position 600 of the striker 403*a* relative to the latch lever 231 and the first axis of rotation pin 235. In this position, there is no abutment between the engagement tab 233*c* of the latch cancel lever 233 and the first engagement surface 231*c* of the latch lever 231. As illustrated in FIG. 8B, the ratchet member engagement 700 involves the end of the ratchet locking portion 237*d* coming into abutment with the second engagement surface 231*d* of the latch lever 231. The resilient member 243 is extended against the rotation of the latch lever 231 caused by the movement of the roller arm 301, and the reception of the striker 403*a* which rotates the latch lever 231. In this state, if the third open cable 180 was retracted, the open lock unlocking lever 239 would rotate in a clockwise direction and the abutment between the ratchet locking portion 237*d* and the second engagement surface 231*d* of the latch lever 231 would be removed. As a result, latch lever 231 would rotate in a clockwise direction, and the latch cancel lever 233 would not be rotated.

FIG. 8C illustrates a front view of the roller hinge arm 301, open lock/canceling latch assembly 230, striker 403*a*, and the full open stopper 403*b*. A direction of motion of the roller hinge arm 301, roller bracket 305, and roller 307 is towards the striker 403*a*. In this locked position the striker fits between first portion 231*a* and the second portion 231*b* of the latch lever 231. Further, a gap 800 exists between a side surface 301*d* of the roller hinge arm 301 and a full open stopper 403*b* of the full open locking member 403. As illustrated in FIG. 8C, the gap 800 corresponds to a stroke and position of the latch lever 231.

An operation of the open lock/canceling device in a situation in which the motor 111 of the first closed lock device 110 malfunctions will be described with reference to FIGS. 9A-10B. If the power of the motor 111 is no longer transmitted to create the motion of the lock device release lever 117 or the seesaw lever 113 via the active lever 112, an operation of the lock device cancel lever 119 in the clockwise direction will disengage the transmission of power from the motor 111 to the release lever 117 by disengaging a relay lever 118. This will allow the lock device open lever 114 and/or the seesaw lever 113 to be positioned in such a way that a pawl driving lever 115 permits the locking and unlocking of the lock device latch 116 by manual operation.

In this situation, the open door lock/canceling latch device 230 may be operated in order to retract the latch cancel cable 270 and cause the lock device latch lever 119 to rotate in the clockwise direction and disengage the motor 111 from the rest of the rear lock device 110. In order to perform this function, the latch lever 231 must rotate past the locking position 600 so the first engagement surface 231*c* is put in a pressed state 900 against the engagement tab 233*c*, to rotate the latch cancel lever 233, which will pull the latch cancel cable 270.

Figure 9A:
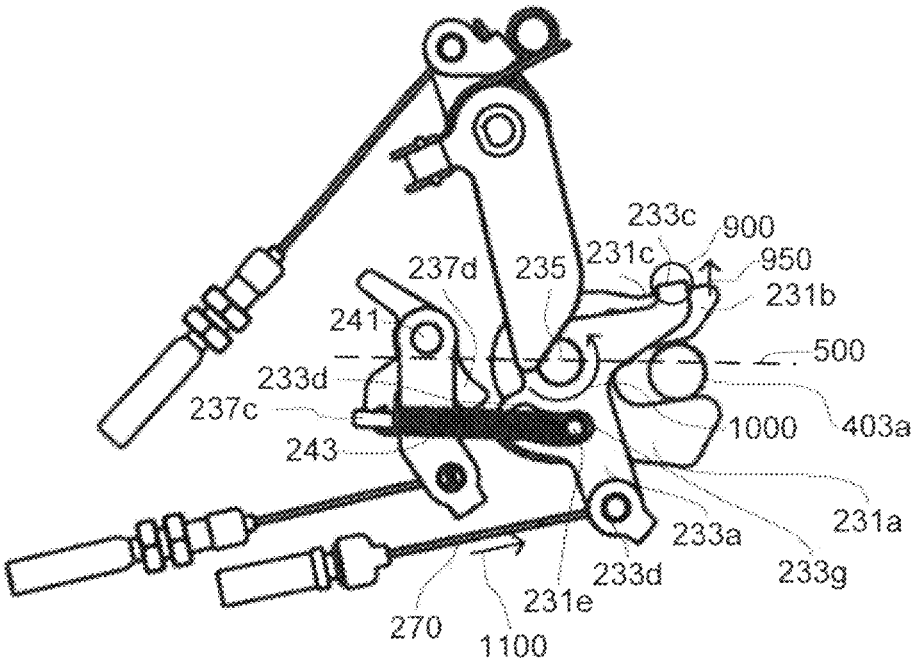
FIG. 9A illustrates a top view of a latch assembly and a striker structure in an overstroke position in accordance with the present disclosure.

As illustrated in FIG. 9A, when the latch lever 231 performs an overstroke motion 950, the rotation pin 235 becomes more closely aligned with the striker 403*a* as shown with reference line 500. The striker 403*a* progresses past the position of the rotation pin 235 in a rear to front direction. Further, in this operation the rotation 1000 of the latch lever 231 is such that the second engagement surface 231*d* of the latch lever 231 becomes disengaged from the ratchet locking portion 237*d*, while the resilient member 243 is further extended as the latch lever pin 231*e* comes into contact with the second pinhole end 233*g*. As illustrated in FIG. 9A, this causes a retracting motion 1100 of the latch cancel cable 270 in a pulling direction which in turn pulls the lock device cancel lever 119.

Figure 9B:
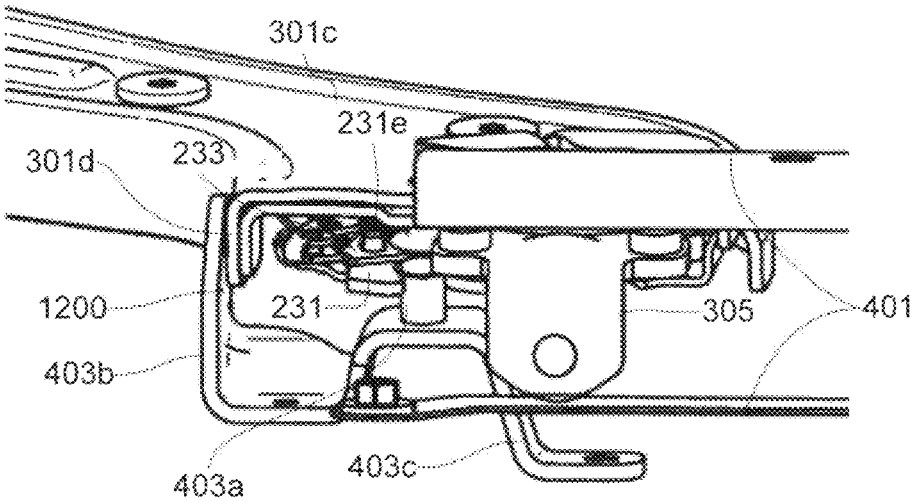
FIG. 9B illustrates a front view of an arm assembly including a latch assembly engaged with a striker structure in an overstroke position in accordance with the present disclosure.

As illustrated in FIG. 9B, in the overstroke position, the first portion 231*a* of the latch lever 231 is substantially even with the position of the latch lever pin 231*e* relative to the striker 403*a*. As illustrated by a comparison of FIGS. 8B and 9A with the position of the striker 403*a* relative to the reference axis 500, it is shown that the striker 403*a* and the rotation pin 235 move closer to being level with one another. Further, as illustrated in FIG. 9B, in the overstroke position the stopper engagement surface 301*d* of the arm 301 comes into abutment with the open stopper 403*b* as shown with the overstroke stopper surface engagement 1200. Further the roller bracket 305 overlaps the front end of a stopper frame 403*c*.

Figure 10A:
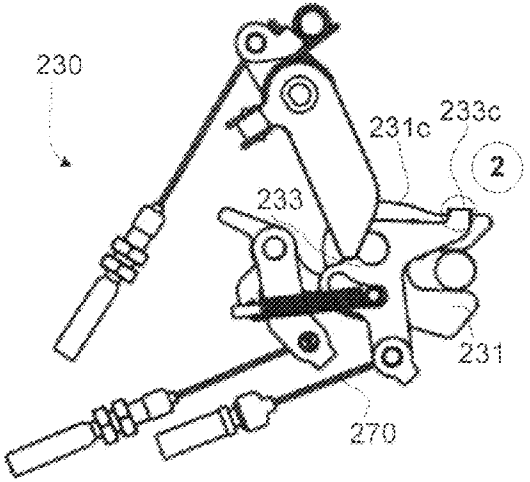
FIG. 10A illustrates front and top views of a locked position in accordance with the present disclosure.
Figure 10A:
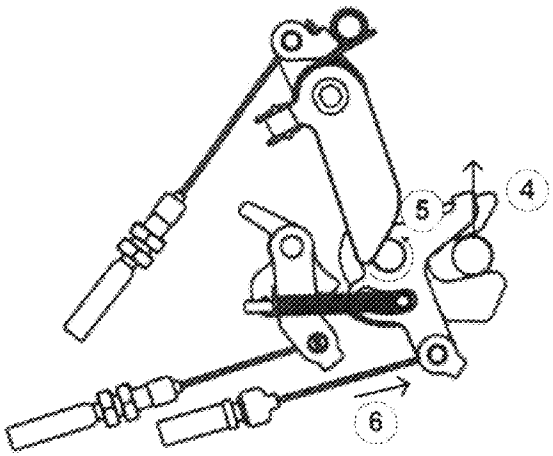
Figure 10A:
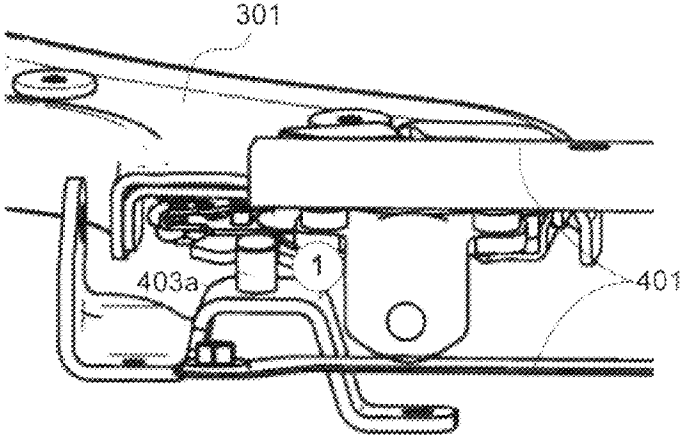

Various advantages of the locking system in accordance with the present disclosure will now be described with reference to FIGS. 10A and 10B. FIG. 10A illustrates a front view of the roller hinge arm 301 and a top view of the open lock/canceling latch assembly 230 in a locked position of the latch lever 231. As shown with reference to numeral (1), the striker 403*a* is fully received by the latch lever 231. At the same time with reference to numeral (2), the engagement tab 233*c* of the latch cancel lever 233 is not engaged with the first engaging surface 231*c* of the latch lever 231. In this position, the sliding door 10 is locked in an open position.

From a position illustrated in FIG. 10A, or other positions of the sliding door 10 along the rail 401, a passenger that is alerted to a malfunction of the rear lock device 110 may operate the sliding door 10 in one of two ways to ensure the sliding door 10 may be returned to a closed position and locked. In the event there is no accompanying malfunction with the power sliding door actuator 400, a user may use a remote control device, such as a remote control key, to operate the sliding door to move past a full open locked position of the door. However, should there be an issue with the power sliding door actuator 400, a user may unlock the open lock condition by operating an inside or outside handle. A user would be able to manually move the sliding door past the open lock position so that the cancel cable 270 could be operated. As a result, the cancel lever 119 of the rear lock device 110 would be operated, and the transmission of power of the motor 111 to other levers (113, 114, 115) of the rear lock device 110 would be interrupted.

Figure 10B:
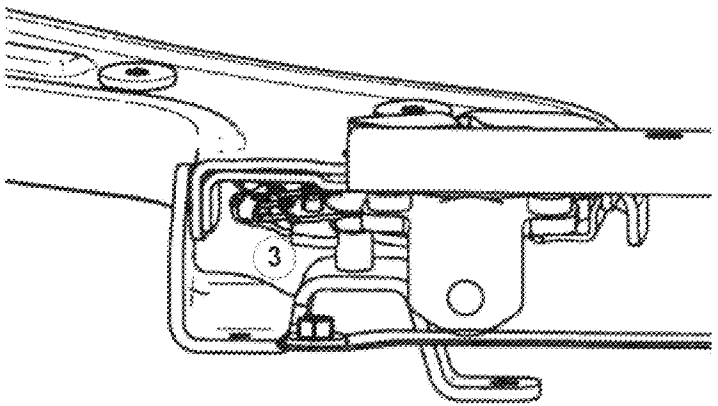
FIG. 10B illustrates front and top views of an overstroke position in accordance with the present disclosure.

The operation of the sliding door to create the overstroke condition as illustrated in FIG. 10B with reference to numeral (3), wherein the movement of the latch lever 231 against the striker 403*a* results in additional rotation of the latch lever 231, is easily employed by a user. With reference to numeral (4), there is provided an abutment of the engagement tab 233*c* with the first engagement surface 231*c*, which results in the rotation of latch cancel lever 233 with reference to numeral (5), and finally a retraction of the cancel cable 270 with reference to numeral (6). Whereas the cable of the related locking system was connected between a lock device and a remote control, availability of a cancel operation may be dependent on the lock or unlocked condition of the remote control. In the locking system of the present disclosure, the cancel cable 270 is connected directly to the open lock/canceling latch assembly 230 installed in the roller hinge arm 301 of the vehicle door 10. As a result, the overstroke condition can be effected by a user regardless of the locked or unlocked condition of the remote control device 100.

The latch cancel cable 270 can be actuated using a manual operation by the user of moving a door past the open locked position or in other systems when a motor of a power sliding door that moves the door in the front and rear directions is not malfunctioning can be used to cause the door to move to the overstroke position and cancel the release lever and the seesaw lever engagement with the motor of the first closed door locking device.

Obviously, numerous modifications and variations of the present invention are possible in light of the above teachings. It is therefore to be understood that within the scope of the appended claims, the invention may be practiced otherwise than as specifically described herein.

The invention claimed is:

1. A latch assembly for vehicle door arm assembly, the vehicle door arm assembly including a striker, the latch assembly comprising:

a latch lever including a first engagement surface, a second engagement surface, and a latch lever pin that extends from a surface of the latch lever, and a cancel lever including an engagement tab that extends from a surface of the cancel lever, a mounting portion to which a cancel cable is mounted, and a latch pinhole through which the latch lever pin extends;

a rotation pin around which each of the latch lever and the cancel lever rotates, wherein the latch lever is configured to receive the striker between the first engagement surface and the second engagement surface which rotates the latch lever in a first direction relative to the cancel lever and the latch lever pin moves within the latch pinhole, wherein the latch assembly is in a locking position when the latch lever is rotated to a first position so that the latch lever pin is located at an end of the latch pinhole, and wherein the latch lever rotates more than the first position, the latch lever contacts the engagement tab so that the latch lever and cancel lever rotate together and the cancel lever retracts the cancel cable.

2. The latch assembly of claim 1, wherein the cancel cable includes a first end and a second end, wherein the first end is connected to the mounting portion of the cancel lever and the second end is connected to a canceling member of a door mechanism, wherein the door mechanism includes an electric motor and a power transmission mechanism that applies a driving force of the electric motor to release a lock of the door, and wherein the rotation of the cancel lever retracts the cancel cable and actuates the cancel member to interrupt a transmission of the driving force of the electric motor to the lock by the power-transmission member.

3. The latch assembly of claim 1, wherein the cancel lever is mounted above the latch lever.

4. The latch assembly of claim 3, wherein a side of the latch lever contacts the engagement tab to rotate the cancel lever about the rotation pin with the latch lever and retracts the cancel cable.

5. The latch assembly of claim 1, wherein the latch assembly further comprises:

a ratchet including a resilient member mounting portion to which a first end of a resilient member is mounted and a ratchet locking portion that engages with the second engagement surface.

6. The door arm assembly of claim 5, wherein a second end of the resilient member is connected to the latch lever pin, and wherein the latch lever rotates in the first direction against a biasing force applied by the resilient member to the latch lever pin.

7. A vehicle door opening and closing device a comprising:

an inside handle that is operated from a vehicle interior;

an outside handle that is operated from a vehicle exterior;

a locking mechanism including a lock that is actuated at a predetermined position of a vehicle door to lock the vehicle door in a locking state;

an open mechanism that is operated according to an operation of the inside handle or an operation of the outside handle to release the lock of the locking mechanism in the locking state;

a release mechanism including an electric motor and a power-transmission member that transmits power of the electric motor to the open mechanism to actuate the open mechanism by a driving force of the electric motor to release the lock from the locking state;

a cancel mechanism that interrupts a transmission of the driving force of the electric motor to the open mechanism by the power-transmission member; and an arm assembly attached to the vehicle door to engage a lower rail in a vehicle body and including a latch assembly operably connected to the cancel mechanism by a cancel cable, wherein the latch assembly moves with the vehicle door and receives a striker in a locked position of the vehicle door and the cancel cable does not move to actuate the cancel mechanism, and wherein the latch assembly moves with the vehicle door past the locked position the cancel cable retracts to actuate the cancel mechanism.

8. The vehicle door opening/closing device of claim 7, wherein the latch assembly comprises:

a latch lever including a first engagement surface, a second engagement surface, and a latch lever pin that extends from a surface of the latch lever, and a cancel lever including an engagement tab that extends from a surface of the cancel lever, a mounting portion to which a cancel cable is mounted, and a latch pinhole through which the latch lever pin extends;

a rotation pin around which each of the latch lever and the cancel lever rotates, wherein the latch lever is configured to receive the striker between the first engagement surface and the second engagement surface which rotates the latch lever in a first direction relative to the cancel lever and the latch lever pin moves within the latch pinhole, wherein the latch assembly is in a locking position when the latch lever is rotated to a first position so that the latch lever pin is located at an end of the latch pinhole, and wherein the latch lever rotates more than the first position, the latch lever contacts the engagement tab so that the latch lever and cancel lever rotate together and the cancel lever retracts the cancel cable.

* * * * *